US007811066B2

(12) United States Patent
Ishikawa et al.

(10) Patent No.: US 7,811,066 B2
(45) Date of Patent: Oct. 12, 2010

(54) DOUBLE-HEADED PISTON TYPE COMPRESSOR

(75) Inventors: Mitsuyo Ishikawa, Kariya (JP); Shoji Takemoto, Kariya (JP); Toshiyuki Banno, Kariya (JP); Jun Kondo, Kariya (JP); Takeshi Aoki, Kariya (JP)

(73) Assignee: Kabushiki Kaisha Toyota Jidoshokki, Aichi-ken (JP)

( * ) Notice: Subject to any disclaimer, the term of this patent is extended or adjusted under 35 U.S.C. 154(b) by 503 days.

(21) Appl. No.: 11/494,023

(22) Filed: Jul. 26, 2006

(65) Prior Publication Data

US 2007/0031264 A1 Feb. 8, 2007

(30) Foreign Application Priority Data

Jul. 27, 2005 (JP) ..... 2005-217943

(51) Int. Cl.
*F04B 1/12* (2006.01)
*F04B 27/08* (2006.01)

(52) U.S. Cl. ..... 417/269; 417/222.1

(58) Field of Classification Search ..... 417/269, 417/222.1, 222.2; 184/6.16
See application file for complete search history.

(56) References Cited

U.S. PATENT DOCUMENTS 4,701,110 A * 10/1987 Iijima ..... 417/269
5,181,834 A * 1/1993 Ikeda et al. ..... 417/269
5,478,212 A * 12/1995 Sakai et al. ..... 417/269
6,837,691 B2 * 1/2005 Tarutani et al. ..... 417/269
6,988,875 B2 * 1/2006 Shintoku et al. ..... 417/269
7,281,905 B2 * 10/2007 Saiki et al. ..... 417/269
2003/0108436 A1 * 6/2003 Shintoku et al. ..... 417/269
2003/0146053 A1 * 8/2003 Shintoku et al. ..... 184/6.16
2004/0253118 A1 * 12/2004 Inoue et al. ..... 417/222.1
2006/0228229 A1 * 10/2006 Inoue ..... 417/269

FOREIGN PATENT DOCUMENTS

JP 09-209927 8/1997
JP 9-209927 8/1997
JP 2003-247486 9/2003

OTHER PUBLICATIONS

Chinese Office Action dated Sep. 28, 2007, received in corresponding Chinese Patent Application No. 200610107490.0 with English translation.

* cited by examiner

*Primary Examiner*—Devon C Kramer
*Assistant Examiner*—Amene S Bayou
(74) *Attorney, Agent, or Firm*—Locke Lord Bissell & Liddell LLP

(57) ABSTRACT

In a double-headed piston type compressor provided with a rotary valve in a rotary shaft, the rotary valve has an introducing port for introducing refrigerant from a suction-pressure region through a supply passage and a respective suction port into a compression chamber. A shaft seal between a front housing and the rotary shaft for preventing leakage of refrigerant along a peripheral surface of the rotary shaft is accommodated in a shaft seal chamber formed in the front housing. A communication passage connects the shaft seal chamber to the cam chamber. A communication groove is formed in an outer peripheral surface of the rotary shaft that forms the rotary valve adjacent to the front housing for communication between the introducing port and the shaft seal chamber. The supply passage and the cam chamber are in communication through the communication groove, the shaft seal chamber and the communication passage.

9 Claims, 4 Drawing Sheets

DOUBLE-HEADED PISTON TYPE COMPRESSOR

BACKGROUND OF THE INVENTION

The present invention relates generally to a double-headed piston type compressor and more particularly to a compressor having a rotary shaft which is provided with a rotary valve having an introducing port for introducing therethrough refrigerant from a suction-pressure region of the compressor into a compression chamber and also having a shaft seal between a front housing and the rotary shaft for preventing the leakage of refrigerant along the peripheral surface of the rotary shaft.

FIG. 6 shows a double-headed piston type compressor C of prior art. The left and right sides of the compressor C of FIG. 6 correspond to the front and rear sides thereof, respectively. The compressor C has a housing assembly which includes a pair of cylinder blocks 80, a front housing 81 connected to the front end of the cylinder blocks 80 and a rear housing 82 connected to the rear end of the cylinder blocks 80. The paired cylinder blocks 80 define therein a cam chamber 83. The cam chamber 83 accommodates a swash plate 85 which is integrated with a rotary shaft 84. The swash plate 85 engages with a double-headed piston 86 in such a way that the piston 86 is movable reciprocally in conjunction with the rotation of the rotary shaft 84 through the swash plate 85. In the compressor C, a compression chamber 87 is defined in each cylinder bore 80*a* formed in the cylinder blocks 80 by the piston 86, and a rotary valve 88 is provided for introducing refrigerant into the compression chamber 87.

To be more specific, a part of the rotary shaft 84 is formed so as to function as the rotary valve 88 for each cylinder block 80. The rotary valve 88 includes a supply passage 90 that axially extends in the rotary shaft 84 and communicates with a suction chamber 89. The rotary valve 88 is provided with an introducing port 91 for communication between the compression chamber 87 and the supply passage 90 thereby to introduce therethrough refrigerant into the compression chamber 87.

In the above-described compressor C, a shaft seal 92 is provided between the front housing 81 and the rotary shaft 84 and accommodated in a shaft seal chamber 81*a* formed in the front housing 81 for preventing refrigerant from leaking along the peripheral surface of the rotary shaft 84 and flowing out of the compressor C. The shaft seal 92 degrades early and deteriorates in sealing performance unless appropriately lubricated. Therefore, the compressor C has a lubricating structure for ensuring lubrication of the shaft seal 92, which is, for example, disclosed in the Japanese Patent Application Publication No. 2003-247486.

The lubricating structure includes a lubricating passage 93, the shaft seal chamber 81*a*, a communication hole 94 and the supply passage 90. The lubricating passage 93 is formed in the front cylinder block 80 and the front housing 81. The communication hole 94 is formed in the rotary shaft 84. The lubricating passage 93 connects the cam chamber 83 and the shaft seal chamber 81*a* for communication therebetween. The communication hole 94 radially extends through the peripheral wall of the rotary shaft 84 for communication between the supply passage 90 and the shaft seal chamber 81*a* on the outer side of the rotary shaft 84.

Pressure of refrigerant in the compression chamber 87 of the cylinder bore 80*a* during a discharge stroke of its piston 86 is higher than that in the cam chamber 83. For this reason, refrigerant in the compression chamber 87 tends to leak into the cam chamber 83 through a slight gap between the outer peripheral surface of the piston 86 and the inner peripheral surface of the cylinder bore 80*a*. This leakage of refrigerant increases the pressure in the cam chamber 83 higher than that of the supply passage 90 thereby to produce a pressure differential between the supply passage 90 and the cam chamber 83. As a result, refrigerant in the cam chamber 83 flows through the lubricating passage 93, the shaft seal chamber 81*a* and the communication hole 94 to the supply passage 90. Thus, lubricating oil contained in the refrigerant that has flowed into the shaft seal chamber 81*a* lubricates the shaft seal 92.

In the lubricating structure disclosed in the Japanese Patent Application Publication No. 2003-247486, the communication hole 94 radially extends through the peripheral wall of the rotary shaft 84 so for communication of the supply passage 90 and the shaft seal chamber 81*a*. This has caused some weak portions of the rotary shaft 84.

The present invention is directed to a double-headed piston type compressor that improves the strength of the rotary shaft while ensuring lubrication of its shaft seal.

SUMMARY OF THE INVENTION

In accordance with the present invention, a double-headed piston type compressor has a housing assembly, a rotary shaft, a cam, a double-headed piston, a rotary valve, a shaft seal, a communication passage and a communication groove. The housing assembly includes a front housing, a rear housing and a pair of cylinder blocks held between the front housing and the rear housing. The pair of cylinder blocks defines therein a cam chamber, a suction-pressure region, suction ports and a plurality of cylinder bores. The rotary shaft is rotatably supported by the housing assembly and includes a supply passage that communicates with the suction-pressure region. The cam is accommodated in the cam chamber for rotation with the rotary shaft. The double-headed piston is accommodated in each of the cylinder bores around the rotary shaft and defines a compression chamber in the respective cylinder bore. The rotary valve is integrally formed with the rotary shaft and has an introducing port for introducing refrigerant from the suction-pressure region through the supply passage and the respective suction port into the compression chamber. The shaft seal is provided between the front housing and the rotary shaft for preventing leakage of refrigerant along a peripheral surface of the rotary shaft. The shaft seal is accommodated in a shaft seal chamber formed in the front housing. The communication passage connects the shaft seal chamber to the cam chamber. The communication groove is formed in an outer peripheral surface of the rotary shaft that forms the rotary valve adjacent to the front housing for communication between the introducing port and the shaft seal chamber. The supply passage and the cam chamber are in communication through the communication groove, the shaft seal chamber and the communication passage.

Other aspects and advantages of the invention will become apparent from the following description, taken in conjunction with the accompanying drawings, illustrating by way of example the principles of the invention.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Figure 1:
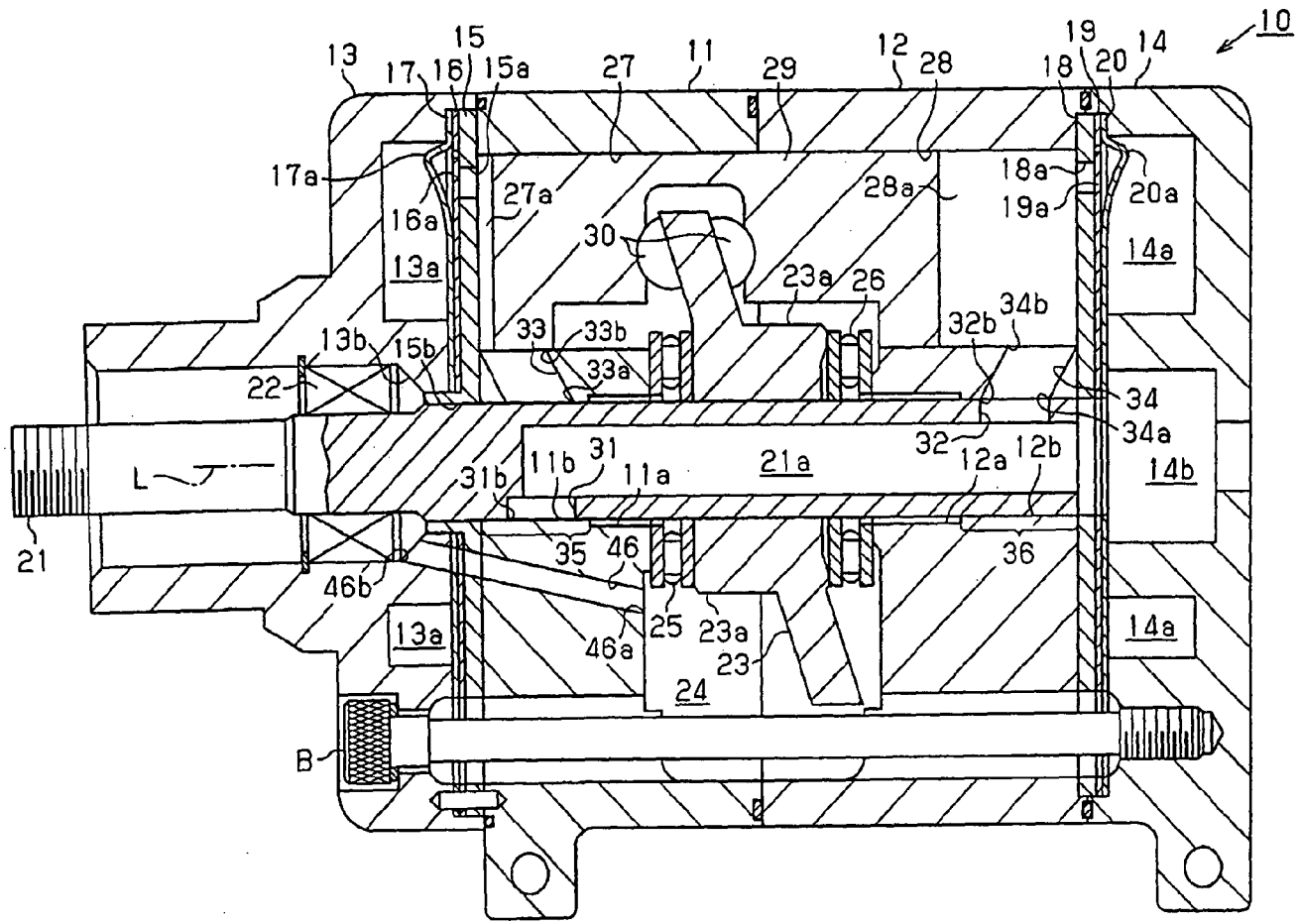
FIG. 1 is a sectional view of a double-headed piston type compressor according to a preferred embodiment.

The following will describe one preferred embodiment of a double-headed piston type compressor according to the present invention with reference to FIGS. 1 through 4B. Referring firstly to FIG. 1 showing a double-headed piston type compressor 10 in sectional view, the left side corresponds to the front side of the compressor 10 and the right side to the rear side of the compressor 10.

As shown in FIG. 1, the compressor 10 has a housing assembly which includes a pair of cylinder blocks 11, 12 connected to each other, a front housing 13 connected to the front end of the front cylinder block 11 and a rear housing 14 connected to the rear end of the rear cylinder block 12. The cylinder blocks 11, 12, the front housing 13 and the rear housing 14 are fastened together by a plurality of bolts B (five bolts B being used in this embodiment, but only one being shown in FIG. 1). A discharge chamber 13*a* is formed in the front housing 13 and a discharge chamber 14*a* and a suction chamber 14*b* are formed in the rear housing 14. The suction chamber 14*b* is a part of a suction-pressure region in the compressor 10.

A valve port plate 15, a discharge valve plate 16 and a retainer plate 17 are interposed between the front housing 13 and the front cylinder block 11. Similarly, a valve port plate 18, a discharge valve plate 19 and a retainer plate 20 are interposed between the rear housing 14 and the rear cylinder block 12. The valve port plates 15, 18 have discharge ports 15*a*, 18*a*, respectively. The discharge valve plates 16, 19 have discharge valves 16*a*, 19*a*, respectively. The discharge valves 16*a*, 19*a* are operable to open and close the discharge ports 15*a*, 18*a*, respectively. Retainers 17*a*, 20*a* are formed in the retainer plates 17, 20 for regulating the degree of opening of the discharge valves 16*a*, 19*a*, respectively.

The cylinder blocks 11, 12 rotatably support a rotary shaft 21 which is inserted through shaft holes 11*a*, 12*a* formed in the cylinder blocks 11, 12, respectively. The rotary shaft 21 extends through an insertion hole 15*b* formed at the center of the valve port plate 15. The rotary shaft 21 is directly supported by the cylinder blocks 11, 12 in the shaft holes 11*a*, 12*a* and, in operation of the compressor 10, the rotary shaft 21 rotates in sliding contact with the inner peripheral surface of the insertion hole 15*b*. A shaft seal 22 of lip seal type is interposed between the front housing 13 and the rotary shaft 21. The shaft seal 22 is accommodated in a shaft seal chamber 13*b* which is formed in the front housing 13. The discharge chamber 13*a* in the front housing 13 is provided around the shaft seal chamber 13*b*.

A swash plate 23 which serves as a cam is secured to the rotary shaft 21 for rotation therewith. The swash plate 23 is accommodated in a cam chamber 24 formed within the paired cylinder blocks 11, 12. A thrust bearing 25 is interposed between the end surface of the front cylinder block 11 and an annular boss portion 23*a* of the swash plate 23. Another thrust bearing 26 is interposed between the end surface of the rear cylinder block 12 and the boss portion 23*a* of the swash plate 23. The thrust bearings 25, 26 rotatably hold the swash plate 23 from opposite sides thereof for regulating the movement of the swash plate 23 in axial direction L of the rotary shaft 21.

Plural pairs of front and rear cylinder bores 27, 28 (five pairs in this embodiment, but only pair of cylinder bores being shown in FIG. 1) are arranged around the rotary shaft 21 in the front and rear cylinder blocks 11, 12, respectively. Each pair of front and rear cylinder bores 27, 28 accommodates therein a double-headed piston 29. Thus, the paired cylinder blocks 11, 12 cooperate to form a cylinder for the double-headed piston 29.

The rotating movement of the swash plate 23 is transmitted to the double-headed pistons 29 through a pair of shoes 30, so that that the double-headed pistons 29 reciprocate in their associated cylinder bores 27, 28. Compression chambers 27*a*, 28*a* are defined in the respective cylinder bores 27, 28 by the double-headed piston 29. Sealing surfaces 11*b*, 12*b* are formed on the inner peripheral surfaces of the shaft holes 11*a*, 12*a*, respectively, through which the rotary shaft 21 is inserted. The rotary shaft 21 is directly supported by the cylinder blocks 11, 12 through the sealing surfaces 11*b*, 12*b*.

Figure 2A:
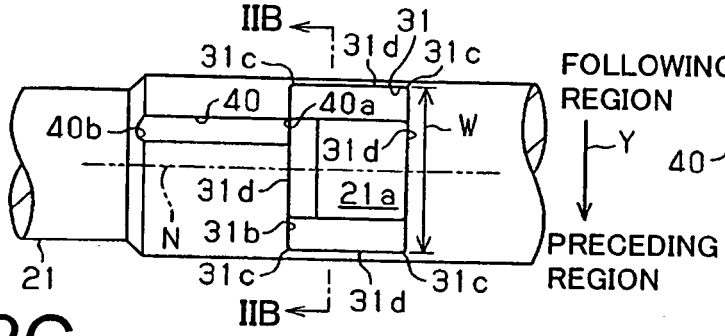
FIG. 2A is a partial plan view of an introducing port and a communication groove of a rotary valve according to the preferred embodiment.

The rotary shaft 21 has a supply passage 21*a* extending axially thereof. The supply passage 21*a* is open at one end thereof to the suction chamber 14*b* in the rear housing 14. The rotary shaft 21 has an introducing port 31 at a position adjacent to the front valve port plate 15 and has an introducing port 32 at a position adjacent to the rear valve port plate 18, respectively, for communication with the supply passage 21*a*. The radially outer openings of the introducing ports 31, 32 in the rotary shaft 21 are designated as outlets 31*b*, 32*b*, respectively. As shown in FIG. 2A, each of the outlets 31*b*, 32*b* of the introducing ports 31, 32 (only outlet 31*b* being shown in FIG. 2A) has a rectangular shape having short sides extending in the direction of the axis L of the rotary shaft 21 and long sides extending perpendicularly to the axis L. Four inner corner edges 31*c* of the outlets 31*b*, 32*b* (only edges 31*c* of the outlet 31*b* being shown in FIG. 2A) are rounded or formed in a circular arc shape, respectively.

Referring again to FIG. 1, the front cylinder block 11 has suction ports 33 for communication between the shaft hole 11*a* and the respective cylinder bores 27. Each suction port 33 has an inlet 33*a* that is open at the sealing surface 11*b* of the rotary shaft 21 and also an outlet 33*b* that is open to the compression chamber 27*a* of the cylinder bore 27. The rear cylinder block 12 also has suction ports 34 for communication between the shaft hole 12*a* and the respective cylinder bores 28. Each suction port 34 has an inlet 34*a* that is open at the sealing surface 12*b* of the rotary shaft 21 and an outlet 34*b* that is open to the compression chamber 28*a* of the cylinder bore 28. As the rotary shaft 21 rotates, the outlets 31*b*, 32*b* of the introducing ports 31, 32 intermittently communicate with the inlets 33*a*, 34*a* of the suction ports 33, 34, respectively. The portions of the rotary shaft 21 which are surrounded by the sealing surfaces 11*b*, 12*b* serve as rotary valves 35, 36 which are integrally formed with the rotary shaft 21.

In the above compressor 10, when the piston 29 for the front cylinder bore 27 is in its suction stroke, that is, when the double-headed piston 29 is moving rightward as seen in FIG. 1, the outlet 31*b* of the introducing port 31 communicates with the inlet 33*a* of the suction port 33. When the piston 29 for the cylinder bore 27 is in its suction stroke, refrigerant in the supply passage 21*a* which is in communication with the suction chamber 14*b* is introduced into the compression chamber 27*a* of the cylinder bore 27 through the introducing port 31 and the suction port 33 until the piston 29 reaches its bottom dead center where the volume of the compression chamber 27*a* becomes the largest.

On the other hand, when the piston 29 for the cylinder bore 27 is in its discharge stroke, that is, when the double-headed piston 29 is moving leftward as seen in FIG. 1, the fluid communication between the outlet 31*b* of the introducing port 31 and the inlet 33*a* of the suction port 33 is shut off. When the piston 29 for the cylinder bore 27 is in its discharge stroke, refrigerant in the compression chamber 27*a* is discharged into the discharge chamber 13*a* through the discharge port 15*a* while pushing open the discharge valve 16*a* until the piston 29 reaches its top dead center where the volume of the compression chamber 27*a* becomes the smallest. Refrigerant discharged into the discharge chamber 13*a* then flows out into an external refrigerant circuit (not shown). The refrigerant circuit including the compressor 10 and the external refrigerant circuit contains lubricating oil which flows with refrigerant.

When the piston 29 for the rear cylinder bore 28 is in its suction stroke, that is, when the double-headed piston 29 is moving leftward in FIG. 1, the outlet 32*b* of the introducing port 32 communicates with the inlet 34*a* of the suction port 34. When the piston 29 for the cylinder bore 28 is in its suction stroke, refrigerant in the supply passage 21*a* of the rotary shaft 21 is introduced into the compression chamber 28*a* of the cylinder bore 28 through the introducing port 32 and the suction port 34 until the piston 29 reaches its bottom dead center.

On the other hand, when the piston 29 for the cylinder bore 28 is in its discharge stroke, that is, when the double-headed piston 29 is moving rightward in FIG. 1, communication between the outlet 32*b* of the introducing port 32 and the inlet 34*a* of the suction port 34 is shut off.

When the piston for the cylinder bore 28 is in its discharge stroke, refrigerant in the compression chamber 28*a* is discharged into the discharge chamber 14*a* through the discharge port 18*a* while pushing open the discharge valve 19*a* until the top dead center is reached by the piston 20. Refrigerant discharged into the discharge chamber 14*a* then flows out thereof and into the external refrigerant circuit. The refrigerant flowing through the external refrigerant circuit returns to the suction chamber 14*b* of the compressor 10.

The compressor 10 has a communication passage 46 that extends through the front housing 13, the valve port plate 15, the discharge valve plate 16, the retainer plate 17 and the front cylinder block 11. The communication passage 46 is located in the lower side of the cylinder block 11 and extends between any two adjacent cylinder bores 27, 27. The inlet 46*a* of the communication passage 46 is open to the cam chamber 24, while the outlet 46*b* thereof is open to the shaft seal chamber 13*b*. In other words, the communication passage 46 connects the shaft seal chamber 13*b* to the cam chamber 24.

Figure 2B:
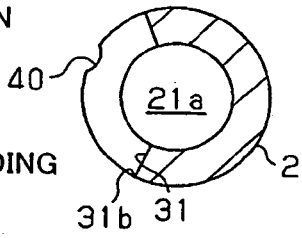
FIG. 2B is a sectional view taken along the line IIB-IIB in FIG. 2A.
Figure 2C:
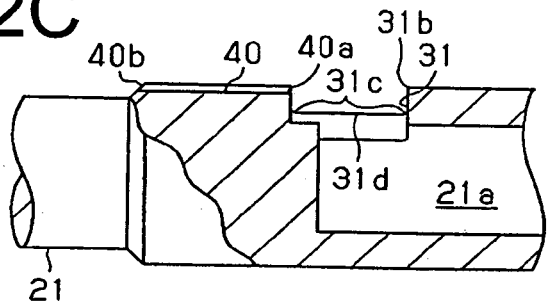
FIG. 2C is a partially sectional view of the introducing port and the communication groove of the rotary valve according to the preferred embodiment.
Figure 4A:
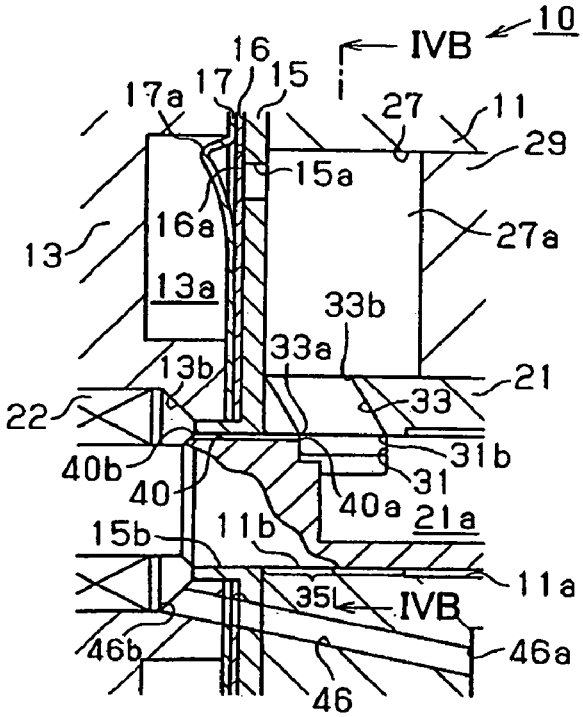
FIG. 4A is a sectional view of the rotary valve and its surroundings when the double-headed piston is positioned at a bottom dead center according to the preferred embodiment of the present invention.

In the rotary valve 35 facing the front cylinder block 11, the rotary shaft 21 that forms the rotary valve 35 has a communication groove 40 on its outer peripheral surface as shown in FIGS. 2A through 2C. As shown in FIG. 4A, the communication groove 40 is formed in the outer peripheral surface of the rotary shaft 21 ranging from the outlet 31*b* of the introducing port 31 to the shaft seal chamber 13*b*. In other words, as shown in FIGS. 2A through 2C, the communication groove 40 does not radially extend through the peripheral wall of the rotary shaft 21 but is formed in the peripheral wall of the rotary shaft 21 by recessing the outer peripheral surface thereof.

The communication groove 40 has a first groove end 40*a* that communicates with the outlet 31*b* of the introducing port 31 and a second groove end 40*b* that is open to the shaft seal chamber 13*b*. Therefore, the communication groove 40 is in communication with the supply passage 21*a* through the introducing port 31 via the outlet 31*b* and also in communication through the supply passage 21*a* with the suction chamber 14*b* which is a part of the suction-pressure region of the compressor 10. As a result, the shaft seal chamber 13*b* and the supply passage 21*a* are in communication with each other through the communication groove 40 and the introducing port 31. The communication groove 40 connects the shaft seal chamber 13*b* to the introducing port 31, so that the communication passage 46 connects the supply passage 21*a* to the cam chamber 24 that communicates with the shaft seal chamber 13*b*.

The first groove end 40*a* is not in connection with the inner corner edges 31*c* adjacent to the shaft seal chamber 13*b* at the outlet 31*b* of the introducing port 31. The first groove end 40*a* is formed at a linear open edge 31*d* other than the edges 31*c*. The communication groove 40 is formed in a linear shape extending in parallel relation to the axis L of the rotary shaft 21.

In FIG. 2A, the arrow Y indicates the direction in which the rotary shaft 21 rotates. The outlet 31*b* of the introducing port 31 has an opening width W as measured along the rotating direction of the rotary shaft, as shown in FIG. 2A, and the reference symbol N designates a bisector of the opening width W of the outlet 31*b*. Of the two regions of the introducing port 31 divided by the bisector N, the region that is brought into communication with the inlet 33*a* of the suction port 33 ahead of or earlier than the other region during the rotation of the rotary shaft 21 is referred to as the preceding region and the other region as the following region, respectively.

Figure 3A:
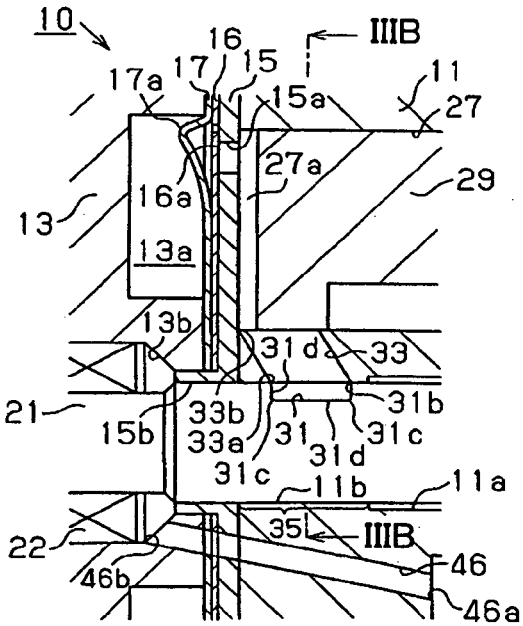
FIG. 3A is a sectional view of the rotary valve and its surroundings when a double-headed piston is positioned at a top dead center according to the preferred embodiment of the present invention.
Figure 4B:
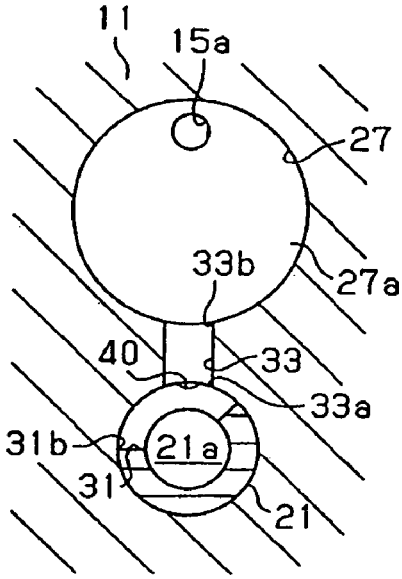
FIG. 4B is a sectional view taken along the line IVB-IVB in FIG. 4A.

Immediately after the double-headed piston 29 initiates its suction stroke for the cylinder bore 27 or moving from its top dead center toward the toward the bottom dead center, the preceding region of the introducing port 31 is brought into direct communication at the inlet 31*b* thereof with the inlet 33*a* of the suction port 33, as shown in FIG. 3A. When the double-headed piston 29 has moved close to its bottom dead center during its suction stroke for the cylinder bore 27, on the other hand, the following region of the port 31 is brought into direct communication at the outlet 31*b* thereof with the inlet 33*a* of the suction port 33, as shown in FIGS. 4A and 4B.

The communication groove 40 is formed on the side of the following region of the introducing port 31, that is, on the side corresponding to the bottom dead center. In other words, the first groove end 40*a* of the communication groove 40 is in communication with the outlet 31*b* of the introducing port 31 in the following region. Due to this structure, when the double-headed piston 29 is positioned near the top dead center and the outlet 31*b* of the introducing port 31 is in communication with the inlet 33*a* of the suction port 33, the communication groove 40 does not directly communicate with the inlet 33*a* of the suction port 33.

On the other hand, when the double-headed piston 29 is positioned near the bottom dead center and the outlet 31*b* of the introducing port 31 communicates with the inlet 33*a* of the suction port 33 on the side corresponding to the bottom dead center, the communication groove 40 then directly communicates with the suction port 33. The communication groove 40 is not located at a position on the outer peripheral surface of the rotary shaft 21 corresponding to a top portion of the swash plate 23 where the double-headed piston 29 is positioned at the top dead center, but at a position on the outer peripheral surface of the rotary shaft 21 that is spaced from the top portion toward the following region in the rotating direction of the rotary shaft 21.

In the above compressor 10, pressures of refrigerant in the compression chambers 27*a*, 28*a* of the cylinder bores 27, 28 during a discharge stroke are higher than that in the cam chamber 24. Therefore, a small amount of refrigerant in the compression chambers 27*a*, 28*a* leaks during the discharge stroke into the cam chamber 24 through a gap between the peripheral surface of the double-headed piston 29 and the peripheral surfaces of the cylinder bores 27, 28. This leakage of refrigerant makes the pressure in the cam chamber 24 to be a slightly higher than that in the supply passage 21*a* and the suction chamber 14*b*, with the result that a pressure differential is produced between the supply passage 21*a* and the cam chamber 24.

Refrigerant in the cam chamber 24 flows through the communication passage 46, the shaft seal chamber 13*b* and the communication groove 40 to the supply passage 21*a*. As a result, part of the refrigerant partially reaches the shaft seal chamber 13*b* wherein the lubricating oil flowing with the refrigerant lubricates the shaft seal 22 in the shaft seal chamber 13*b*. When the double-headed piston 29 shifts its movement from a discharge stroke to a suction stroke and moves toward the bottom dead center, pressure in the compression chamber 27*a* becomes lower than that in the supply passage 21*a* (suction pressure region).

Figure 3B:
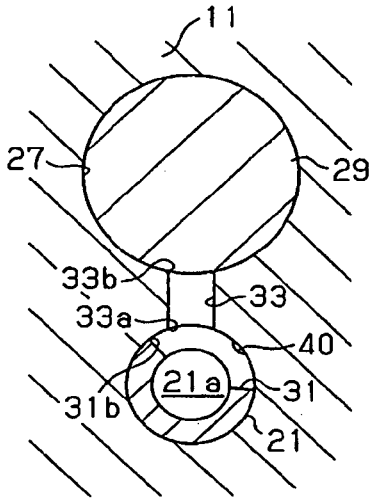
FIG. 3B is a sectional view taken along the line IIIB-IIIB in FIG. 3A.

As shown in FIGS. 3A and 3B, the first groove end 40*a* of the communication groove 40 communicates with the outlet 31*b* of the introducing port 31 in the following region of the rotary shaft 21. When the double-headed piston 29 is positioned near the top dead center, the communication groove 40 is not directly in communication with the inlet 33*a* of the suction port 33. This helps refrigerant in the supply passage 21*a* to be introduced into the suction port 33. This introduction of refrigerant prevents a large amount of refrigerant from flowing from the cam chamber 24 to the supply passage 21*a* through the communication groove 40. As a result, refrigerant in the cam chamber 24 is prevented from flowing rapidly into the compression chamber 27*a* through the communication groove 40 and also from rapidly flowing to the shaft seal chamber 13*b* which is located midway between the cam chamber 24 and the compression chamber 27*a*.

As shown in FIGS. 4A and 4B, when the double-headed piston 29 further moves toward a position near the bottom dead center and the drawing of refrigerant into the cylinder bore 27 is caused only by the movement of the double-headed piston 29 without a pressure differential between the compression chamber 27*a* and the supply passage 21*a*, the following region of the introducing port 31 communicates with the inlet 33*a* of the suction port 33. In other words, the communication groove 40 that is in communication with the following region of the introducing port 31 directly communicates with the inlet 33*a* of the suction port 33. Then, refrigerant in the cam chamber 24 flows slowly through the communication passage 46, the shaft seal chamber 13*b* and the communication groove 40 to the supply passage 21*a*.

According to the preferred embodiment of the present invention, the following advantageous effects are obtained.

(1) The communication groove 40 is formed in the outer peripheral surface of the rotary shaft 21 for communication between the introducing port 31 and the shaft seal chamber 13*b*, and the supply passage 21*a* and the cam chamber 24 are in communication through the shaft seal chamber 13*b*, the communication passage 46 and the communication groove 40. Thus, a pressure differential produced between the cam chamber 24 and the supply passage 21*a* causes refrigerant containing lubricating oil to flow from the cam chamber 24 through the communication passage 46, the shaft seal chamber 13*b* and the communication groove 40 to the supply passage 21*a*. Accordingly, the lubricating oil flowing with the refrigerant into the shaft seal chamber 13*b* lubricates the shaft seal 22 in the shaft seal chamber 13*b*, thus ensuring lubrication of the shaft seal 22.

The communication groove 40 is recessed in the peripheral wall of the rotary shaft 21 for communication between the shaft seal chamber 13*b* and the supply passage 21*a*. Unlike the structure wherein a hole is bored through the peripheral wall of the rotary shaft 21 for communication between the shaft seal chamber 13*b* and the supply passage 21*a*, and the rotary shaft 21 will have no portion with an extremely lower strength by boring a hole through the peripheral wall of the rotary shaft 21. In comparison to the structure wherein a hole is formed through peripheral wall of the rotary shaft 21, the strength of the rotary shaft 21 will be much improved.

(2) The communication groove 40 is formed in the outer peripheral surface of the rotary shaft 21. The communication groove 40 is made more easily that a hole is formed through the wall of the rotary shaft 21 for communication between the supply passage 21*a* and the outer peripheral side of the rotary shaft 21. Thus, the lubricating mechanism for the shaft seal 22 in the compressor 10 according to the preferred embodiment may be formed easily.

(3) The communication groove 40 is formed in the outer peripheral surface of the rotary shaft 21. For example, when a through-hole connects the supply passage 21*a* of the rotary shaft 21 to the outer side of the rotary shaft 21, this eliminates a need for perforating the supply passage 21*a* to a position near the through-hole in order to minimize the length of the through-hole for preventing the rotary shaft 21 from lowering in strength. In other words, in comparison to the structure wherein a through-hole connects the supply passage 21*a* to the outer side of the rotary shaft 21, the length of the supply passage 21*a* to be formed in the rotary shaft 21 may be shortened, thus contributing to the improvement in strength of the rotary shaft 21.

(4) The first groove end 40*a* of the communication groove 40 is formed in communication with the outlet 31*b* of the introducing port 31 at a position in the following region of the rotary shaft 21 with respect to the bisector N. When the double-headed piston 29 moves to a position near the bottom dead center and the pressures in the compression chamber 27*a* and the supply passage 21*a* become substantially the same, the communication groove 40 directly communicates with the inlet 33*a* of the suction port 33. Therefore, refrigerant in the cam chamber 24 flows through the communication passage 46, the shaft seal chamber 13*b* and the communication groove 40 to the supply passage 21*a* merely by the pressure differential between the cam chamber 24 and the supply passage 21*a*. When the double-headed piston 29 just initiates to move from the top dead center toward the bottom dead center, a pressure differential is produced between the compression chamber 27*a* and the supply passage 21*a* and, if the communication groove 40 then communicates with the inlet 33*a* of the suction port 33, refrigerant in the cam chamber 24 rapidly flows into the compression chamber 27*a*. According to the preferred embodiment, however, this rapid flow of refrigerant is prevented. As a result, the shaft seal 22 is prevented from being damaged by refrigerant that flows rapidly in a large amount into the shaft seal chamber 13*b* located midway between cam chamber 24 and the compression chamber 27*a*.

(5) The first groove end 40*a* and the second groove end 40*b* of the communication groove 40 are formed in the following region of the rotary shaft 21 with respect to the bisector N. The communication groove 40 has a linear shape extending in parallel relation to the axis L of the rotary shaft 21. Therefore, in comparison to the structure wherein the communication groove 40 is formed extending in a direction that obliquely intersects with the axis L of the rotary shaft 21, the length for communication between the shaft seal chamber 13*b* and the introducing port 31 can be shorter. In other words, a length of the communication groove 40 formed on the outer peripheral surface of the rotary shaft 21 may be shorter and the communication groove 40 may be formed easily.

(6) The outlet 31*b* of the introducing port 31 has a rectangular shape. The first groove end 40*a* of the communication groove 40 is in communication with the linear open edge 31*d* of the outlet 31*b* of the introducing port 31 and in communication with the introducing port 31 at a position other than the edges 31*c* adjacent to the accommodating chamber 13*b*. In the outlet 31*b* of the introducing port 31, the edges 31*c* are formed in combination by the open edges 31*d* for forming the opening of the outlet 31*b*. The edges 31*c* are lower in strength than the linear open edges 31*d*. Therefore, the communication groove 40 is in communication with the outlet 31*b* at a position other than the outlet 31*b* of the introducing port 31 having a lower strength. Thus, even when the rotary shaft 21 is subjected to a bending and/or twisting force, the outlet 31*b* is prevented from being damaged at its peripheral edge by the presence of the communication groove 40.

(7) The communication groove 40 is not located at a position on the outer peripheral surface of the rotary shaft 21 corresponding to a top portion of the swash plate 23 to position the double-headed piston 29 at the top dead center, but at a position on the outer peripheral surface of the rotary shaft 21 corresponding to a portion spaced from the top portion toward the following region of the rotary shaft 21. Therefore, when the double-headed piston 29 is positioned at the top dead center, a large force acts on a portion of the rotary shaft 21 corresponding to the top portion of the swash plate 23. However, this preferred embodiment prevents such force from acting directly on the communication groove 40.

(8) The communication groove 40 is formed in the outer peripheral surface of the rotary shaft 21, and refrigerant containing lubricating oil passes through the communication groove 40. Therefore, the outer peripheral surface of the rotary shaft 21 having the communication groove 40 and the inner peripheral surface of the insertion hole 15*b* through which the rotary shaft 21 is inserted at the valve port plate 15 are supplied with lubricating oil. This ensures thorough lubrication of the sliding surfaces of the rotary shaft 21 and the insertion hole 15*b*. Thus, smooth rotation of the rotary shaft 21 is accomplished.

The present invention is not limited to the above-described embodiment, but may be modified into various alternative embodiments as exemplified below.

In an alternative embodiment, the outlet 31*b* of the introducing port 31 has a polygonal shape or a circular shape.

Figure 5:
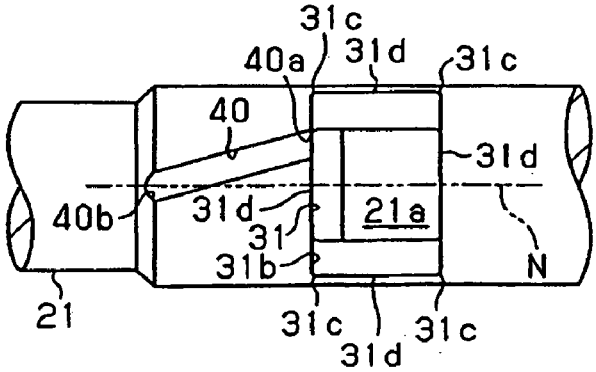
FIG. 5 is a partially plan view of a rotary valve showing a communication groove according to an alternative embodiment.
Figure 6:
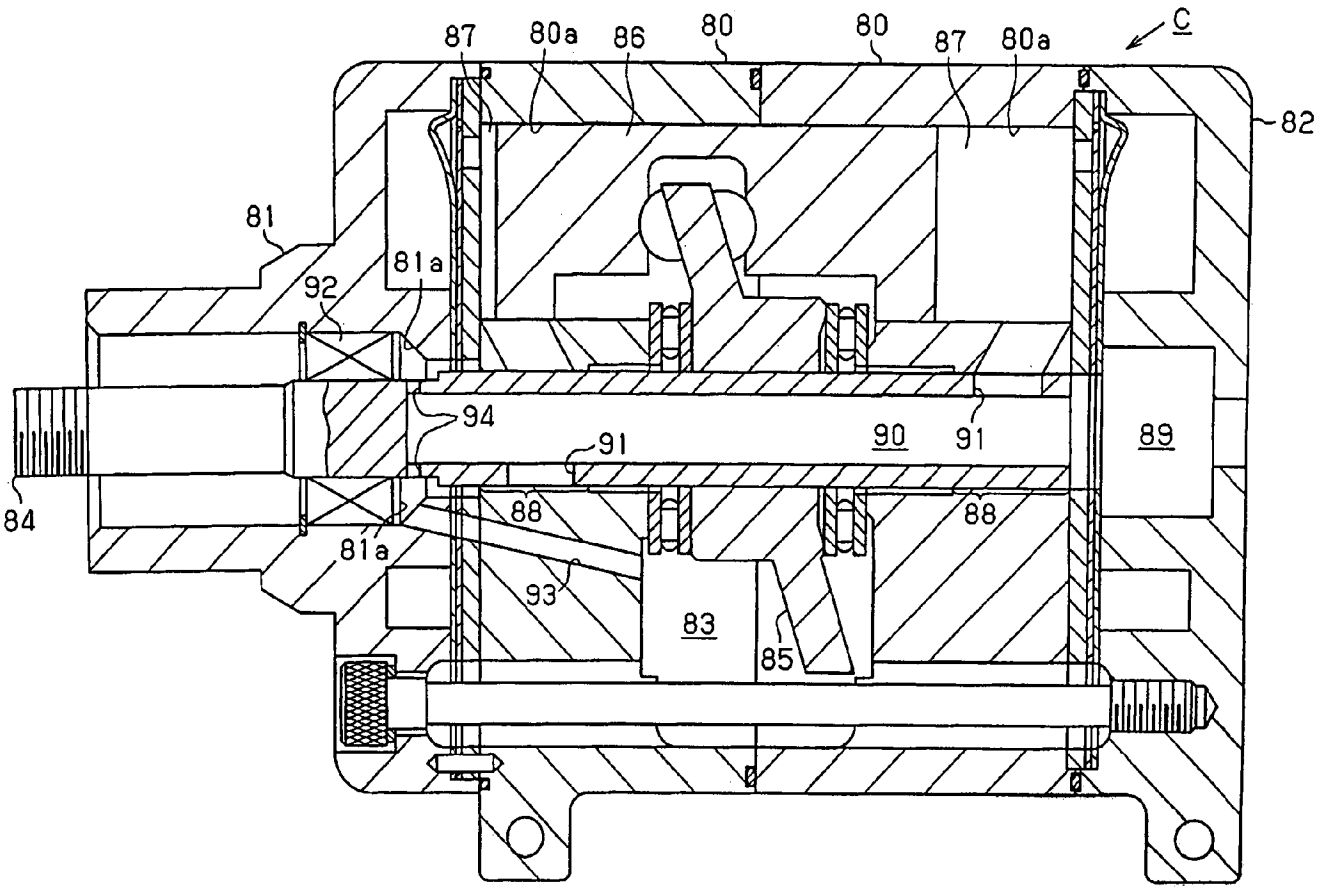
FIG. 6 (PRIOR ART)
FIG. 6 is a sectional view of a double-headed piston type compressor according to a prior art.

In another alternative embodiment, as shown in FIG. 5, the communication groove 40 extends in a direction that obliquely intersects with the axis L of the rotary shaft 21. In this case, the first groove end 40*a* of the communication groove 40 should preferably be formed in the following region of the rotary shaft 21 with respect to the bisector N.

In a still another alternative embodiment, the first groove end 40*a* of the communication groove 40 is connected with the edge 31*c* of the outlet 31*b* of the introducing port 31 adjacent to the shaft seal chamber 13*b*. In a further alternative embodiment, the communication groove 40 is formed in the outer peripheral surface of the rotary shaft 21 at a position of the bisector N.

Therefore, the present examples and embodiments are to be considered as illustrative and not restrictive, and the invention is not to be limited to the details given herein but may be modified within the scope of the appended claims.

What is claimed is:

1. A double-headed piston type compressor comprising:

a housing assembly including a front housing, a rear housing and a pair of cylinder blocks, comprising a front cylinder block and a rear cylinder block, held between the front housing and the rear housing, the pair of cylinder blocks defining therein a cam chamber, a suction-pressure region, suction ports and a plurality of cylinder bores;

a rotary shaft rotatably supported by the housing assembly, the rotary shaft including a supply passage having a front end, that communicates with the suction-pressure region, wherein the front end of the supply passage is located rearward of a front end of the front cylinder block;

a cam accommodated in the cam chamber for rotation with the rotary shaft;

a double-headed piston accommodated in each of the cylinder bores around the rotary shaft, the double-headed piston defining a compression chamber in the respective cylinder bore;

a rotary valve integrally formed with the rotary shaft, the rotary valve having an introducing port for introducing refrigerant from the suction-pressure region through the supply passage and the respective suction port into the compression chamber;

a shaft seal provided between the front housing and the rotary shaft for preventing leakage of refrigerant along a peripheral surface of the rotary shaft, wherein the shaft seal is accommodated in a shaft seal chamber formed in the front housing; wherein the front end of the front cylinder block faces the shaft seal chamber;

a communication passage formed in the front cylinder block and connecting the shaft seal chamber to the cam chamber; and a communication groove formed in an outer peripheral surface of the rotary shaft that forms the rotary valve adjacent to the front housing for communication between the introducing port and the shaft seal chamber, wherein the supply passage and the cam chamber are in communication through the communication groove, the shaft seal chamber and the communication passage, wherein the communication groove has a first groove end and a second groove end, wherein the first groove end communicates with the introducing port and the second groove end communicates with the shaft seal chamber, wherein the introducing port communicates with the suction port from a preceding region of the rotary shaft in its rotating direction to a following region thereof while the double-headed piston is moving from its top dead center where a volume of the compression chamber is the smallest to its bottom dead center where a volume of the compression chamber is the largest, and wherein the first groove end is formed in communication with the introducing port at a position in the following region of the rotary shaft with respect to a bisector of an opening width as measured along a rotating direction of the rotary shaft.

2. The double-headed piston type compressor according to claim 1, wherein the second groove end is formed in communication with the introducing port at a position in the following region of the rotary shaft with respect to the bisector, and wherein the communication groove has a linear shape extending in parallel relation to an axis of the rotary shaft.

3. The double-headed piston type compressor according to claim 1, wherein a radially outer opening of the introducing port in the rotary shaft has a polygonal shape, wherein the first groove end is not in connection with inner corner edges formed by the polygonal shape adjacent to the shaft seal chamber at the radially outer opening of the introducing port and is formed at a linear open edge other than the inner corner edges.

4. The double-headed piston type compressor according to claim 3, wherein the polygonal shape is rectangular.

5. The double-headed piston type compressor according to claim 1, wherein a radially outer opening of the introducing port in the rotary shaft has a polygonal shape, wherein the first groove end is in connection with inner corner edges formed by the polygonal shape adjacent to the shaft seal chamber at the radially outer opening of the introducing port.

6. The double-headed piston type compressor according to claim 1, wherein the communication groove extends in a direction that obliquely intersects with an axis of the rotary shaft.

7. The double-headed piston type compressor according to claim 1, wherein the communication groove is formed in the outer peripheral surface of the rotary shaft at a position of the bisector.

8. The double-headed piston type compressor according to claim 1, further comprising a valve port plate, a discharge valve plate and a retainer plate which are held between the front housing and the cylinder block and between the rear housing and the cylinder block, respectively, wherein the rotary shaft is inserted in an insertion hole formed through the valve port plate adjacent to the front housing, and wherein the communication groove is provided at a sliding surface of the rotary shaft with the insertion hole.

9. The double-headed piston type compressor according to claim 1, wherein a radially outer opening of the introducing port in the rotary shaft has a circular shape.

* * * * *